United States Patent [19]

Leasure et al.

[11] 4,027,579

[45] June 7, 1977

[54] METHOD AND APPARATUS FOR OPENING FOLDED BOX BLANKS

[75] Inventors: William Leasure; Luis Garcia; Charles Reifel; Jack Shelton, all of Houston, Tex.

[73] Assignee: Mira-Pak, Inc., Houston, Tex.

[22] Filed: Apr. 22, 1975

[21] Appl. No.: 570,504

[52] U.S. Cl. ..... 93/53 M; 93/53 R

[51] Int. Cl.[2] ..... B31B 1/78

[58] Field of Search ..... 93/53 M, 53 R, 53 BF, 93/36 R, 49 R, 36 SQ, 52, 48

[56] References Cited

UNITED STATES PATENTS

| | | | |
|---|---|---|---|
| 1,848,707 | 3/1932 | Gangler | 93/53 R |
| 2,116,607 | 5/1938 | Milmoe | 93/53 R X |
| 2,694,350 | 11/1954 | Malhiot | 93/53 R |
| 2,746,363 | 5/1956 | Anderson | 93/53 R |
| 3,748,972 | 7/1973 | Barton | 93/53 R X |
| 3,952,636 | 4/1976 | Reichert | 93/53 R X |

*Primary Examiner*—James F. Coan
*Attorney, Agent, or Firm*—Larson, Taylor and Hinds

[57] ABSTRACT

The present invention relates to a method and apparatus for opening folded box blanks so that the opened blank can be filled. Apparatus of one embodiment of the invention comprises a substantially cylindrical cam having an axially and radially progressing spiral cam surface and a plurality of elongated transport screws for supplying, one at a time, folded box blanks to one end of the cam. The blank is opened upon rotation of the cam.

16 Claims, 6 Drawing Figures

METHOD AND APPARATUS FOR OPENING FOLDED BOX BLANKS

BACKGROUND OF THE INVENTION

1. Field of the Invention

This invention relates to apparatus and a method for opening folded box blanks and more specifically relates to apparatus and a method for automatically supplying a plurality of folded paper box blanks one at a time and automatically opening the box blanks so as to prepare them for receiving an item or items to be inserted into the box blanks.

2. Description of the Prior Art

Modern package manufacturing and packaging techniques have developed to a state whereby the package material is usually manufactured by a first company, the package is manufactured and printed by a second company, and the package is filled by a third company. One type of package which is usually made and filled in this manner is the conventional paper box of the type used to contain crackers, pretzels, and the like. These boxes are usually manufactured as folded box blanks which are purchased in stacks by the contents manufacturer. Hence, there is a demand for an inexpensive yet versatile and reliable means for opening the folded box blanks so that the boxes can be filled.

In the past, the folded box blanks have been opened either manually or with complex devices that are prone to frequent breakdowns. Many of the prior art devices comprise a plurality of mechanical fingers connected to carriers. The carriers are moved through a series of complex motions in order to select one box blank at a time and then to open it. In addition to frequent breakdowns, an additional disadvantage of the prior art devices is that is difficult to interface other mechanical equipment with the box blank openers. This results in the necessity for additional complex apparatus for supplying the folded box blanks and for manipulating and filling the opened box.

SUMMARY OF THE INVENTION

The present invention provides a versatile and efficient paper box blank opener which can operate at high speeds. A device in accordance with the present invention requires little floor space and has a high degree of reliability, integrity, and flexibility. The device is completely automatic and readily adaptable for use with other packaging equipment without the necessity for complex and expensive interfacing equipment. As a result, the present invention provides a relatively inexpensive, relatively maintenance-free and relatively simple device for opening folded box blanks.

A device in accordance with the present invention comprises a means for supplying the folded box blanks and a cam means for receiving the blanks one at a time and for opening the received blanks upon the rotation of the cam means. In one embodiment of the invention, the device further comprises a substantially cylindrical cam having an axially progressing spiral cam surface with a radial dimension which increases as a function of an increasing axial dimension whereby the cam completely opens the supplied box blank in one 360° revolution. In a further embodiment of the present invention, the means for supplying the folded box blanks can be comprised of a pair of screws wherein the box blanks are located in the screw threads and are longitudinally advanced upon rotation of the screw. The aforementioned cam can be located at the end of and integral with one of the screws.

Other details, features and objects of the present invention will be set forth in, or apparent from, the accompanying drawings and the detailed description of a preferred embodiment found hereinbelow.

DETAILED DESCRIPTION OF THE PREFERRED EMBODIMENT

Figure 1:
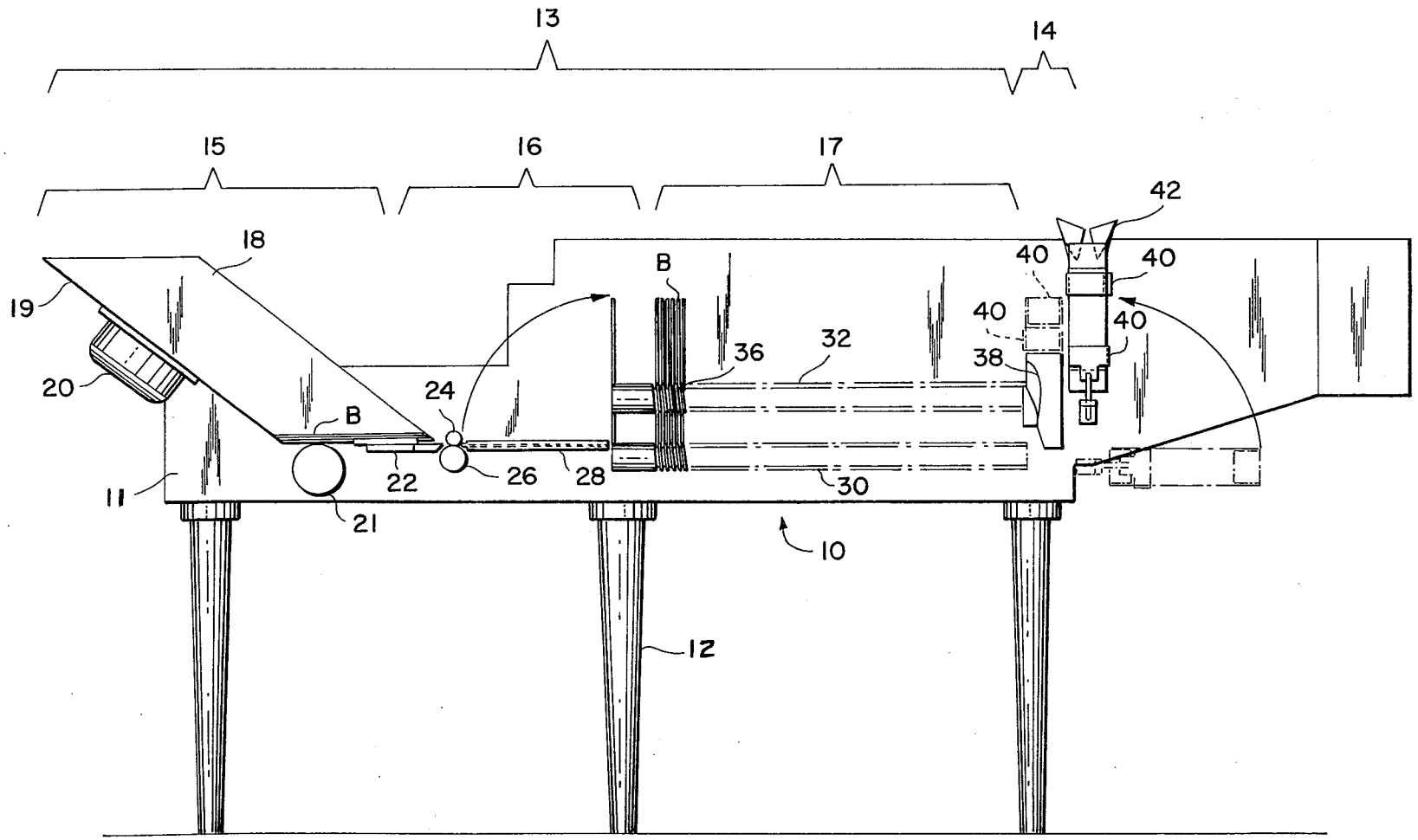
FIG. 1 is a front elevation view with parts cut away in order to show one embodiment of the invention.

With reference to the figures in which like numerals depict like elements, a box blank opening apparatus 10 in accordance with invention is shown in FIG. 1. Apparatus 10 is supported by a frame 11 which in turn is supported by a plurality of legs 12. Frame 11 supports all the components of apparatus 10 and can also be used to support interfacing equipment which receives and transfers an opened box blank. Apparatus 10 comprises a means for supplying folded box blanks 13 and a cam means 14 for receiving the blanks one at a time and for opening the received blank upon the rotation thereof. The means for supplying box blanks (designated by B in the Figures) in turn comprises a storage means 15 for storing a plurality of blanks, a transporting means 17 for transporting blanks B to cam means 14 and a transfer means 16 for transferring the blanks from storage means 15 to transporting means 17.

In the embodiment of the invention shown in FIG. 1, the components of apparatus 10 are shown in a horizontal planar layout. However, it is obvious to one skilled in the art, that various components of apparatus 10 can be arranged in other than a horizontal or planar arrangement. For example, storage means 15 and transfer means 16 can be in a horizontal plane and transporting means 17 can be in a vertical plane.

Storage means 15 comprises a hopper-type magazine 18 having a slanted back 19 for storing a plurality of blanks B in a vertical pile. A vibrator means 20 is mounted on back 19 for vibrating magazine 18 and thereby advancing blanks B along back 19 and maintaining a compact pile. Storage means 15 further comprises a rotatable feed roller 21 which is in contact with the bottom one of the blanks and which upon rotation discharges the bottom blank out of a magazine 18 in a forward direction. A guide plate 22 forms part of the bottom of magazine 18 and directs the movement of the fed blank out of magazine 18.

The fed blank B is received by transfer means 16 which comprises at least an upper loader roller 24 and a lower loader roller 26 and a pivotable loading plate 28 that is positionable between a first, horizontal position and a second, vertical position. In a preferred embodiment of the invention, feed roller 21, upper and lower loader rollers 24 and 26 and a means for positioning said loading plate 28 from the first position to the second position (the means not being shown) are operated in a timed sequence such taht a blank B is fed into loader rollers 24 and 26 by feed roller 21 when loading plate 28 is in the first horizontal position and then loading plate 28 is positioned to the second, vertical position for pickup by transporting means 17.

Figure 2A:
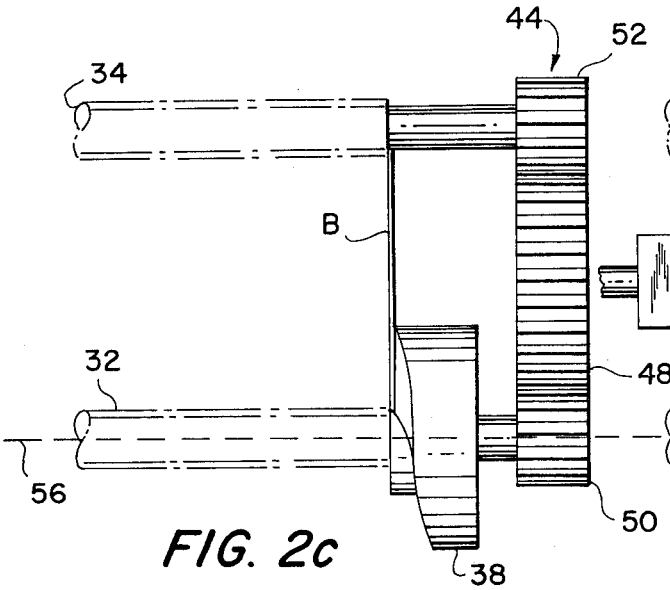
FIG. 2*a* is a plan view of a box blank opening cam in accordance with the invention wherein the cam is shown in the initial or zero degree position.
Figure 2B:
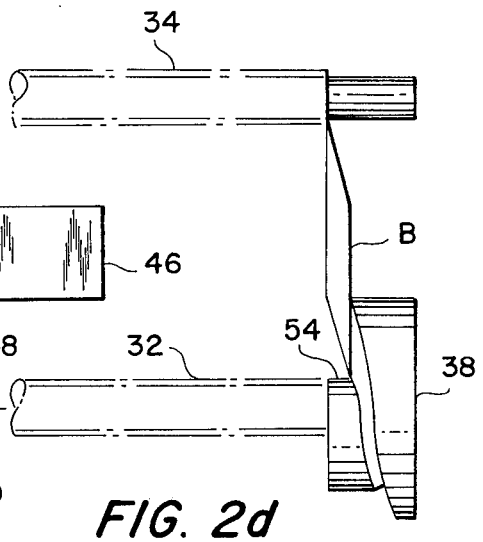
FIG. 2*b* is a plan view similar to FIG. 2*a* in which the cam is shown in the 90° position.
Figure 2C:
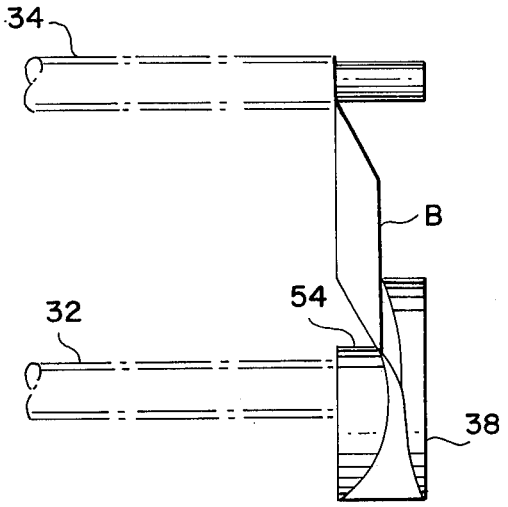
FIG. 2*c* is a plan view similar to FIG. 2*a* in which the cam is shown in the 180° position.
Figure 2D:
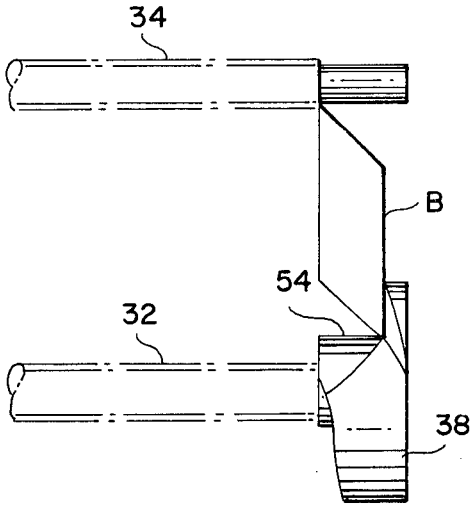
FIG. 2*d* is a plan view similar to FIG. 2*a* in which the cam is shown in the 270° position.

Transporting means 17 comprises a lower pair of transport screws 30 (only one of which is shown) and first and second upper transport screws 32 and 34 (see also FIG. 2*a*). The transport screws in the upper and lower pairs are spaced an equal distance apart in a horizontal transverse direction a sufficient distance such that blanks B can fit in between the threads, designated by numeral 36, of the corresponding transport screw. In the preferred embodiment, threads 36 are right-handed and are cut in single helical groove so as to form a single-thread screw. The form of thread should be such that the blanks B can be maintained in a substantially perpendicular position to the screws. Thread forms of the modified square, acme, and B & S worm thread types are satisfactory. Although the preferred embodiment has the threads on all of the screws shown in the same hand, because the pitch of the threads 36 is small, the threads of any particular screw can be of any convenient hand. Consequently, a plurality of drive arrangements for rotating the transport screws can be utilized. Naturallly, it is preferable in order to prevent binding or slippage of a blank B in threads 36 that the threads of the transport screws on the same side of the blanks B, have the same hand.

Although transport screws 30, 32 and 34 are shown in horizontal planes, it is an obvious modification of the invention to use transport screws that are either inclined or in a vertical plane. Furthermore, although only two pairs of transport screws are shown, it would be an obvious modification to use only one pair of transport screws or more than two pairs of transport screws depending on the size of blanks B.

Located at the distal end of transport screw 32 and integral therewith is a cam 38. Cam 38, as described in greater detail hereinbelow, receives a blank B one at a time and upon the rotation of cam 38 th blank B is opened.

An opened box transfer means, schematically shown in FIG. 1, comprises support collars 40 and box retaining jaws 42. Collars 40 and jaws 42 receive an opened box from cam 38, maintain the box in an opened state and transfer the opened box to a further position for loading. Although the means for moving the opened box transfer means is not shown, it would be obvious that any particular design can be used. In the embodiment of the invention shown in FIG. 1, support collars 40 are U-shaped and are positionable from a first engaging position, shown in phantom lines, to a vertically spaced apart and longitudinally translatable, second position (shown in solid lines). In addition, the opened box transfer means are shown to be pivotable between the upright, second position shown in the solid lines and a third, horizontal position shown in phamtom lines.

The details of cam 38 can best be seen by referring to FIGS. 2*a* through 2*e*. As mentioned above, any suitable drive means may be employed to selectively and synchronously rotate the transport screws and consequently rotate cam 38. One such means is diagramatically shown in FIG. 2*a* in which an electric motor 46 is selectively energized to rotate drive gear 48. Drive gear 48 in turn rotates a first idler gear 50 which is integral to an extension of the shaft of transport screw 32 and a second idler gear 52 which is integral with an extension of the shaft of transport screw 34. It is obvious from the particular drive means disclosed in FIG. 2*a* that both transport screw 32 and transport screw 34 will turn in the same direction. The drive means for rotating lower transport screws 30 can similarly include an idler gear driven by gear 48. It is noted, however, that the particular drive means for operating the transport screws is merely exemplary and any suitable arrangement can be utilized.

Figure 2E:
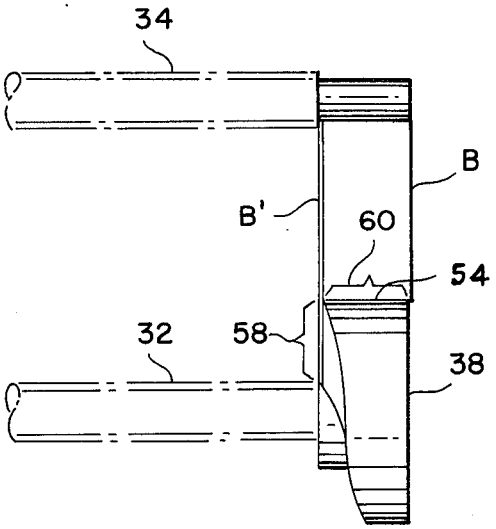
FIG. 2*e* is a plan view similar to FIG. 2*a* in which the cam is shown in the 360° position.

In the presently preferred embodiment of the invention, cam 38 is an elongated cam comprised of an axially progressing, spiral cam surface having a radial distance from the axis of rotation of cam 38 (depicited by numeral 56) that increases as a function of an increasing distance along the axis of rotation 56. Cam surface 54 has a minimum radial distance from axis 56 at the starting or zero degree position of cam 38 (shown in FIG. 2*a*) and has a maximum radial distance from axis 56 after a complete revolution of cam 38 is in the completed cycle position or the 360° position (as shown in FIG. 2*e*). The difference between the maximum radial dimension of cam surface 54 from axis 56 and the minimum radial distance of cam surface 54 from axis 56 is selected so as to be substantially equal to the difference between the width of a folded blank and the width of the blank when it is opened. The axial lenth of cam surface 54 when cam 38 is in the zero degree position is substantially equal to the thickness of the folded box blank B (FIG. 2*e*) and the axial length of cam surface 54 when cam 38 is in the three hundred and sixty degree position is substantially equal to the thickness of the opened box B (FIG. 2*e*). Since the difference in the width of a folded box blank from the width of an opened box blank is substantially equal to the thickness of the opened box blank, it can be seen that the difference in the radial distance of cam surface 54 from axis 56 when cam 38 is in the zero degree position and in the 360° position is substantially equal to the axial length of cam surface 54 when cam 38 is in the 360 ° position. In other words, referring to FIG. 2*e*, radial length 58 of cam 38 is substantially equal to axial length 60 of cam 38.

The opening of a folded box blank B is shown at various stages in FIGS. 2*a* through 2*e*.

Transport screws 30, 32 and 34 axially and longitudinally transport the folded box blanks B and supply them one at a time to cam 38, located at the end of transport screw 32, when cam 38 is in the zero degree position. The edge of box blank B in contact with transport screw 32 can continue to move in a longitudinal direction on cam surface 54 whereas the opposite edge of box blank B in contact with transport screws 30 and 34 is retained and held at the ends of the respective transport screw.

Cam 38 has been designed so that blank B is completely opened upon revolution of cam 38. As can be seen in FIGS. 2*a* through 2*e*, as cam 38 rotates, the distance between cam surface 54 and transport screw 34 diminishes. Consequently, blank B is being slowly compressed along the folded edges thereof. Since cam surface 54 also progresses in an axial direction as the radial distance of cam surface 54 increases, the edge of blank B in contact therewith is forced in an axial direction and is maintained in contact with the cam 38 at the vertex between cam surface 54 and the radial edge of cam 38 which defines the end of cam surface 54. As stated above, the opposite edge of blank B is held at its axial position at the end of the other transport screws. Finally, as shown in FIG. *2e*, box blank B has been completely opened and a second unopened box Blank B has been supplied by the transport screws to cam 38.

Once a box has been opened, interfacing equipment, such as the opened box transfer means shown in FIG. 1, can be used to further position the opened box. One presently preferred use of apparatus 10 is in combination with a flexible bag type package forming apparatus. This combination provides a system for forming and filling flexible bags, placing the bags in opened boxes, sealing the box, and delivering a completed package. Examples of package forming apparatus compatible with the present invention are disclosed in the follow U.S. patents of William C. Leasure: Nos. 3,027,696; 3,543,467; 3,548,563; and 3,785,112.

The lateral squeezing of a box blank B has been shown in the FIG. 2 series of drawings as being accomplished solely by changes in dimensions of cam surface 54. However, it would be obvious that cam surface 54 need only increase in, for example, an axial direction and a second cam could be mounted, for example, on transport screw 34 in which only the radial dimension of the corresponding cam surface increases upon the rotation thereof. In addition, it is also possible that a second cam could be mounted on the lower transport screw on the same side of blank B as transport screw 32. Still further variations and modifications can be made to the disclosed embodiment of the present invention. Nevertheless, all the various embodiments of the invention provide a folded box blank opening device that is relatively inexpensive, very simplistic in design, and very reliable in operation.

Although the invention has been described in detail with respect to exemplary embodiments thereof, it will be understood by those of ordinary skill in the art that variations and modifications may be effected within the scope and spirit of the invention.

We claim:

1. A device for opening folded box blanks comprising:

means for supplying the blanks comprised of rotatably mounted screw means for axially advancing the blanks upon the rotation thereof; and cam means for directly receiving said blanks one at a time and for opening the received blank upon the rotation of said cam means about an axis of rotation.

2. A device as claimed in claim 1 wherein said cam means comprises a substantially cylindrical cam having an axially progressing spiral cam surface whereby a folded blank is received at a first end of said cam and is engaged along one edge thereof by said cam surface.

3. A device as claimed in claim 2 wherein the radial dimension of said cam surface from the axis of rotation increases as a function of an increasing axial dimension from said first end.

4. A device as claimed in claim 3 wherein said cam means completely opens the supplied folded blank in one 360° revolution of said cam and said cam surface has a minimum radial dimension at a 0° position and a maximum radial dimension at a 360° position, and wherein said supplying means supplies the folded blanks one at a time such that a folded edge of the blank engages said cam surface at said 0° position of said cam at said first end thereof and such that said blank is substantially perpendicular to said axis of rotation in both a vertical plane and a transverse plane.

5. A device as claimed in claim 4 wherein the dimensions of said cam are such that the difference between the maximum and the minimum radial dimensions of said cam surface from the axis of rotation is substantially equal to the difference in the width of a supplied folded box blank and the width of an opened box blank, and the axial length of said cam surface at said 360° position is substantially equal to the width of an opened box blank.

6. A device as claimed in claim 1 wherein said screw means comprises a plurality of spaced apart rotatably mounted, elongated screws for retaining and advancing a plurality of blanks, each screw having threads of a size and pitch such that one of the blanks can be retained between adjacent screw threads said blanks being axially advanced upon the rotation of said screws;

and further comprising means for synchronously rotating said plurality of screws.

7. A device as claimed in claim 6 wherein said plurality of screws at least include a first screw and a second screw located on respective sides of the blanks; and wherein said cam means includes a cam mounted on and rotated with one of said first and second screws.

8. A device as claimed in claim 7 wherein said cam means comprises an elongate cam which includes an axially progressing spiral cam surface with a radial distance from the axis of rotation that increases as a function of an increasing distance along the axis of rotation and whereby a folded blank is received at a first end of said cam and is engaged along one folded edge thereof by said cam surface, the other folded edge of the blank being engaged and retained by said other of said first and second screws, whereby upon rotation of said cam the blank is opened.

9. A device as claimed in claim 1 wherein said supplying means further includes a storage means for storing a plurality of blanks and a transfer means for transferring the blanks from said storage means to said screw means.

10. A device as claimed in claim 9 wherein said storage means comprises a magazine having a slanted back for storing a plurality of blanks in a vertical pile, a plurality of feed rollers for receiving and advancing the bottom one of the blanks in the pile, and vibrator means for vibrating said back to advance the blanks in the pile such that a blank is always in contact with said feed rollers.

11. A device as claimed in claim 9 wherein said transfer means comprises a loading plate positionable between a first horizontal position whereby a blank is received from said feed rollers and a second vertical position whereby the blank is positioned for pick up by said screws.

12. A device as claimed in claim 1 wherein said screw means comprises at least one transport screw and wherein said cam means comprises at least one cam, said cam being mounted coaxially with said transport screw at one end thereof.

13. A device as claimed in claim 12 wherein said cam is integrally connected to and rotated with said transport screw.

14. A method of mechanically opening folded blanks having a plurality of folded edges comprising the steps of:

supplying a plurality of blanks to a rotatably mounted screw means for axially advancing the blanks upon the rotation thereof;

rotating said screw means so as to directly present the box blanks one at a time to an opening means comprising a cam and a holding means;

engaging a first folded edge of the blank with said cam;

engaging a second folded edge of the blank with said holding means for holding the second edge of the blank;

and rotating said cam whereby the folded box is increasing compressed at one folded edge with the rotation of said cam and held at the other folded edge, thereby opening said blank.

15. A method as claimed in claim 14 wherein said screw means comprises an elongated screw and said cam and said screw are axially aligned and rotated together so that while said cam is opening one blank, a second blank is being advanced toward said cam.

16. A method as claimed in claim 15 wherein the blank is opened upon one rotation of said cam.

* * * * *